US008124914B2

(12) United States Patent
Yu

(10) Patent No.: US 8,124,914 B2
(45) Date of Patent: Feb. 28, 2012

(54) HAIR IRON WITH DIMPLED FACE PLATES AND METHOD OF USE IN STYLING HAIR

(76) Inventor: Kent Yu, Houston, TX (US)

( * ) Notice: Subject to any disclaimer, the term of this patent is extended or adjusted under 35 U.S.C. 154(b) by 1001 days.

(21) Appl. No.: 12/002,905

(22) Filed: Dec. 19, 2007

(65) Prior Publication Data

US 2009/0159093 A1 Jun. 25, 2009

(51) Int. Cl.
*A45D 1/04* (2006.01)
*A45D 1/06* (2006.01)

(52) U.S. Cl. ..... 219/225; 132/224; 132/272

(58) Field of Classification Search ..... None
See application file for complete search history.

(56) References Cited

U.S. PATENT DOCUMENTS

| | | | | |
|---|---|---|---|---|
| 6,014,977 | A * | 1/2000 | Friedman | 132/232 |
| 6,119,702 | A | 9/2000 | Habib | |
| 6,199,558 | B1 * | 3/2001 | Schmidt et al. | 132/211 |
| 6,223,753 | B1 * | 5/2001 | Lo | 132/224 |
| 6,798,982 | B2 | 9/2004 | Ryu et al. | |
| 6,941,955 | B2 * | 9/2005 | Yao | 132/225 |
| D516,242 | S * | 2/2006 | Habibi | D28/35 |
| 7,271,368 | B2 * | 9/2007 | Yeung | 219/222 |
| 7,397,016 | B2 * | 7/2008 | Aoki et al. | 219/229 |
| 7,540,289 | B2 * | 6/2009 | Habibi | 132/224 |
| 2004/0000319 | A1 * | 1/2004 | Carballada et al. | 132/224 |
| 2005/0056631 | A1 | 3/2005 | Cha | |
| 2005/0229336 | A1 | 10/2005 | Fondin et al. | |
| 2007/0029302 | A1 | 2/2007 | Russo | |
| 2008/0127989 | A1 * | 6/2008 | Chapman et al. | 132/118 |
| 2008/0283080 | A1 * | 11/2008 | Habibi | 132/224 |
| 2009/0114240 | A1 * | 5/2009 | Leung | 132/224 |

FOREIGN PATENT DOCUMENTS

| | | | |
|---|---|---|---|
| JP | 2003-284608 | A | 10/2003 |
| KR | 10-2003-008558 | A | 11/2003 |
| KR | 10-0602870 | B1 | 7/2006 |
| KR | 10-0602874 | | 7/2006 |

* cited by examiner

*Primary Examiner* — Joseph M Pelham
(74) *Attorney, Agent, or Firm* — Berliner & Associates

(57) ABSTRACT

An iron for styling hair containing opposed plates having confronting surfaces for clamping a section of hair therebetween wherein surface one or both of the plates, is formed with a plurality of depressions, e.g., dimples, distributed over its surface. The depressions are of sizes that decrease from opposite outer edges of the plate toward the centerline of the plate. At least one of the plates is heated to a temperature in the range of 380° to 450° F. whereby heat can be applied to the section of hair while clamped between the plates. The plates are preferably formed of zeolite and coated with tourmaline. The hair iron is used to facilitate coloring of hair in which coloring is applied to the hair following which the hair is rinsed and is wet, in which the hair iron is used on the wet hair so as to dry the hair, in lieu of a hair dryer, thereby putting an end to all reactions in the coloring process.

3 Claims, 4 Drawing Sheets

HAIR IRON WITH DIMPLED FACE PLATES AND METHOD OF USE IN STYLING HAIR

FIELD OF THE INVENTION

The invention relates to a curling iron and its method of use in styling hair.

BACKGROUND OF THE INVENTION

There are two types of pigment that give hair its color, eumelanin(black) and pheomelanin(red). All humans have pheomelanin in their hair. How dark it is depends on how much eumelanin is present. A low concentration of eumelanin in the hair will give blonde hair, more eumelanin will give it a brown color, and much higher amounts of eumelanin will result in black hair. Eumelanin in low concentrations causes a yellow tone, in higher concentrations creates a brown color. Also, in general, the more melanin present, the darker the hair color; less melanin, the lighter the hair color. Pheomelanin is more chemically stable than eumelanin, so it breaks down more slowly when oxidized. Bleach will cause darker hair to turn red as it is processing because it has broken down the eumelanin quickly but acts more slowly on the pheomelanin. As the pheomelanin breaks down, the hair will then become orange, and then the chemicals turn it yellow.

All "permanent" hair color products and lighteners contain both a developer, or, oxidizing agent, and an alkalizing ingredient as part of their ammonia or an ammonia substitute. The purpose of this is to raise the cuticle of the hair fiber so the tint can penetrate, facilitate the formation of tints within the hair fiber, and bring about the lightening action of peroxide. When the tint containing the alkalizing ingredient is combined with the developer (usually hydrogen peroxide), the developer becomes alkaline and diffuses through the hair fiber, entering the cortex, where the melanin is located. The lightening occurs when the alkaline peroxide breaks up the melanin and replaces it with new color.

The outer layer of the hair shaft, its cuticle, must be opened before permanent color can be deposited into the hair. Once the cuticle is open, the dye reacts with the inner portion of the hair, the cortex, to deposit or remove the color. Most permanent hair colors use a two-step process (usually occurring simultaneously) which first removes the original color of the hair and then deposits a new color. It's essentially the same process as lightening, except a colorant is then bonded within the hair shaft. Ammonia is the alkaline chemical that opens the cuticle and allows the hair color to penetrate the cortex of the hair. It also acts as a catalyst when the permanent hair color comes together with the peroxide. Peroxide is used as the developer or oxidizing agent. The developer removes pre-existing color. Peroxide breaks chemical bonds in hair, releasing sulfur, which accounts for the characteristic odor of hair color. As the melanin is decolorized, a new permanent color is bonded to the hair cortex. Various types of alcohols and conditioners may also be present in hair color. The conditioners close the cuticle after coloring to seal in and protect the new color.

About 80% of hair consists of elongated cells (cortical cells) of a fibroid structure (macro-fibrils, micro-fibrils). The cortex determines the thickness, elasticity, and strength of the hair. It is also responsible for housing all of the hairs' natural color pigments. Color pigments found in the cortical layer are in the form of minute melanin granules. These granulized color pigments are stored in tiny sacks called alveoli. In healthy hair, light can penetrate the cuticle layer and reflect directly off the melanin pigment in the hair with little refraction, thus producing greater luminosity, and subjectively, truer, more vibrant color. When the cuticle is damaged, refraction convolutes the natural balance of color and the luminosity of the reflected light, resulting in a dull, muddied color.

Problems in using current hair treating formulations include compromised cuticle, non-uniform distribution of pigment, and surface bonding of pigment in coloring. In addition, the distribution of the pigment granules within the structure of the keratin surface will not reflect light uniformly because of the refracted light, causing a dull color that lacks a natural luster. The compromised cuticle also leaves the surface bonded pigment vulnerable to decay because it is now exposed more easily to the elements Ammonia (or other basic materials of pH>8) is used in permanent (oxidative) hair color. When the permanent hair color and the developers come together, the action of ammonia begins. Like all alkaline materials, the ammonia has the tendency to separate the cuticle and allows the permanent hair color to penetrate the cortex of the hair. The ammonia has an effect on the sulfur bonds of the hair. If the ammonia is too harsh, thus penetrating too deeply for too long, the hair will lose more of the sulfur bonds than necessary. It will cause the hair to harden, lose weight and diameter. The higher the volume of the developer, the greater the amount of sulfur is removed from the hair structure. This is one of the reasons why developers are maintained at 30% volume or less for the majority of hair coloring.

Many people believe that continual styling over time and/or heat damages the hair, but neither continual styling nor heat as such is damaging. It is over-styling and heat in the absence of moisture that damages hair. Styling for too long may reduce moisture to unhealthy levels. Once essential moisture in hair has been removed, the hair becomes extremely vulnerable to temperature change in convective and conductive situations. Styling under these conditions will cause hair to lose its elasticity and make the cuticle vulnerable to barbing, opening, electrostatic effects, etc. Damage to the cuticle of the hair will make it more breakable and will make pigment vulnerable to chemical reactions, decay, and diffusion. Too much heat without significant moisture will more easily create steam inside the hair shaft which in turn will burst hair by breaking it.

BRIEF SUMMARY OF THE INVENTION

The present invention in the form of an improved hair iron overcomes the foregoing problems and provides a significant paradigm shift in the history of hair color. It's provides a relatively simple inclusion to already existing procedures, but its necessity as a conclusion to the coloring process and its ongoing use for the maintenance of an end user's color integrity is a significant contribution to the art of hair coloring. In essence, the hair iron of the present invention and its use enables the preservation over time of the integrity of hair color so as to continue to reflect the true conception of the original artwork created by the colorist. The present invention lets stylists bring order and control over color as they never have known before.

In accordance with the invention a hair iron is provided that includes a ceramic plate having a pattern of dimples on its surface for contacting hair during styling. Preferably the hair iron will have opposing dimpled ceramic plates to sandwich hair between them during styling. The dimpled plates create pressure to further penetrate the keratin crystalline structure as well as raise the boiling point of water for quicker more uniform evaporation.

In a particular embodiment of the invention, the plates are formed of an acidic ceramic that has no affinity for hair and contributes to neutralizing the oxidation process as well as more completely sealing the cuticle. More specifically, the plate is formed of the slightly acidic mineral zeolite.

In another particular embodiment of the invention, a control switch for heating the ceramic plates is located at the base of the iron where the cord meets the iron, to facilitate a downward motion involved in using the iron.

In another particular embodiment of the invention, one or both of the plates are coated with tourmaline to generate negative ions and infrared heat, thereby contributing to the overall health of the cuticle. In still another particular embodiment of the invention, the ceramic plates are heated to a temperature in the range of about 380 to 450° F. (193 to 232° C.) preferably about 450° F. to allow a more thorough separation of the keratin crystalline structure, thereby allowing deeper penetration of pigment within keratin to bond.

The invention is further enhanced by the use of digital technology to regulate current into the ceramic heater, without which using heat as high as 450° F. could be hazardous In a further embodiment of the invention, a method of use of the hair iron is provided. The iron of this invention is used during a step in coloring, after the rinse to dry hair (in lieu of a hair dryer). It is to be used only on wet hair, ending the coloring process, i.e., putting an end to all reactions even deep within the cortex. In the past this has been done with vinegar, or by rinsing with conditioners.

The method of this invention deeply seals color into the hair, protects the hair by closing the cuticle, brings order to the crystalline keratin structure, allows deeper penetration of added pigment when bonding with the keratin cortex, and provides a more uniform distribution to the pigment granules, allowing a truer, more brilliant reflection of light from the pigment with little refraction.

The method provides continued longevity in the integrity of the hair color. It should be done 2-3 times a week as required maintenance on wet hair (essentially accomplishing everything above without the need to stop the coloring process since it is only maintenance). The method prolongs the quality of color between coloring sessions.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
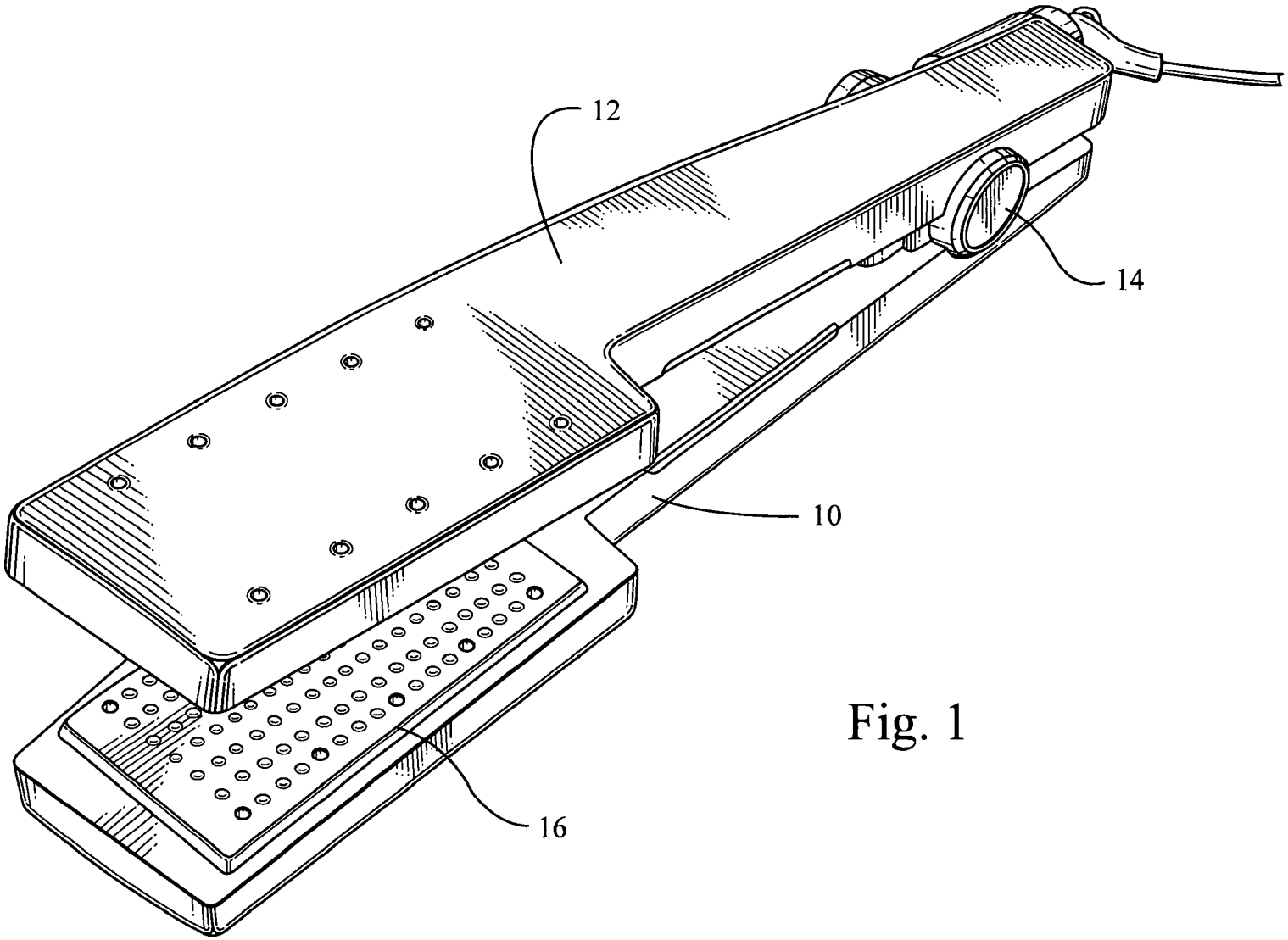
FIG. 1 is a perspective drawing of a hair iron in accordance with the invention.

Referring to FIG. 1, a hair iron in accordance with an embodiment of the invention is shown comprising a lower body 10 and an upper body 12 joined by hinge 14 at their rear ends so that they can meet flexibly while facing each other. A lower heating plate 16 is installed at the front area of the lower body 10 and an upper heating plate 18 (FIG. 3) is installed at the front area of the upper body 12.

Figure 2:
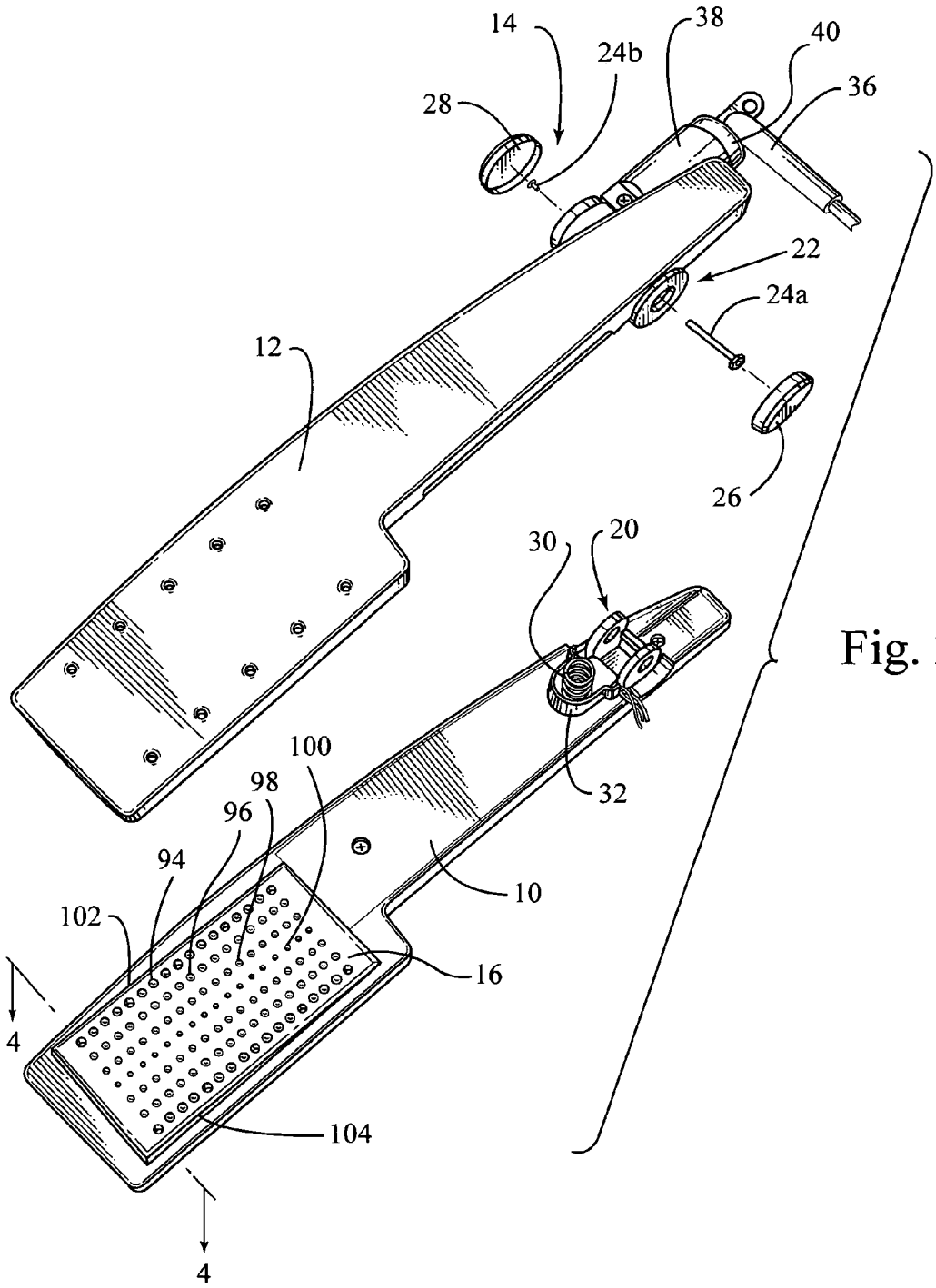
FIG. 2 is an exploded perspective view of hair iron of FIG. 1.
Figure 3:
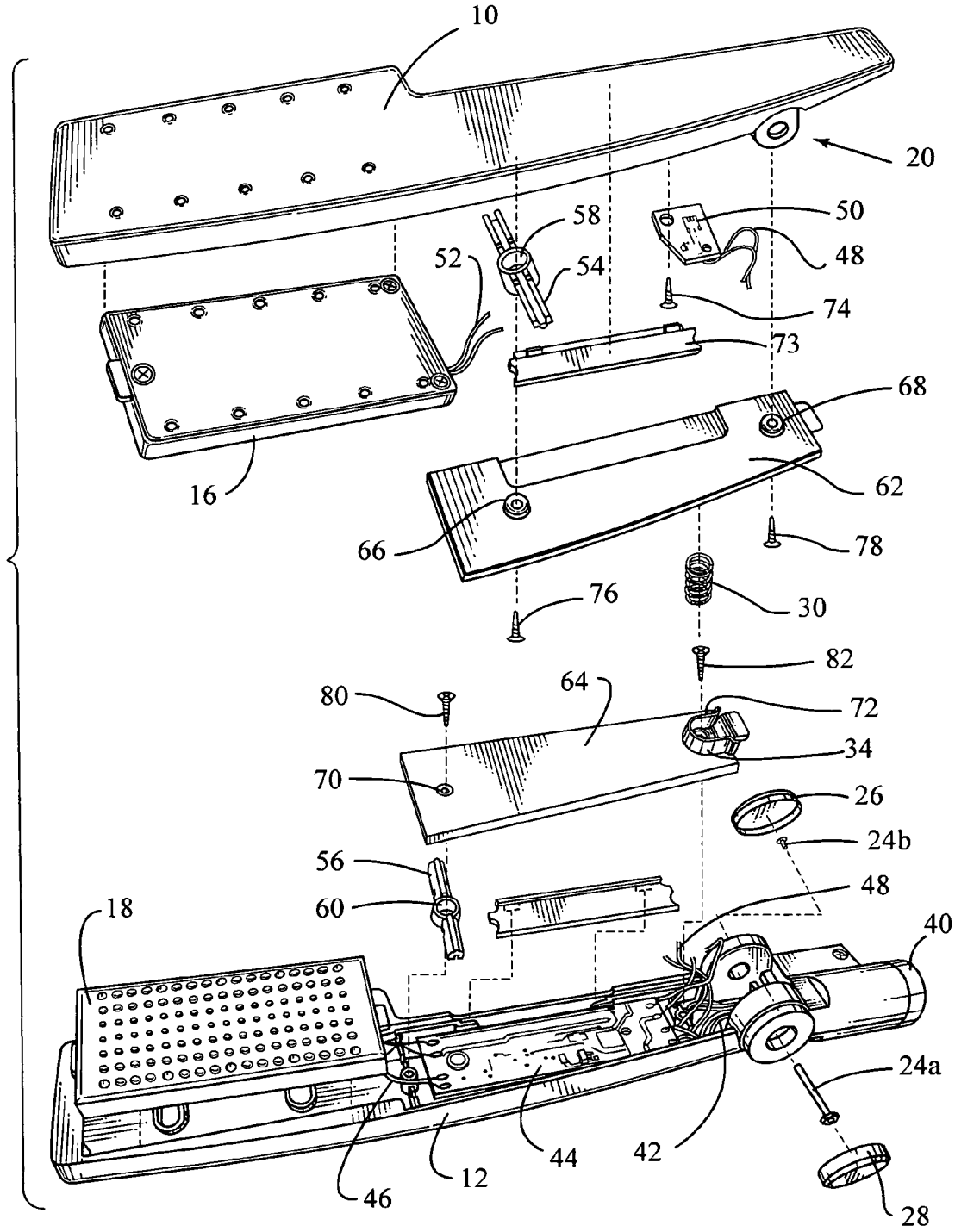
FIG. 3 is a more detailed exploded perspective view of hair iron of FIG. 1 in inverted perspective from FIG. 2.

Referring to FIGS. 2 and 3 (FIG. 3 is in inverted perspective to FIG. 2), the hinge 14 includes lower and upper mating clevises, respectively 20 and 22, secured by a clevis pin 24*a* and 24*b*. A pair of caps 26 and 28 aesthetically covers the hinge. A spring 30 secured within lower and upper telescoping semispherical plastic housings, respectively 32 and 34, is located internally adjacent the hinge 14, and biases the hair iron to an open position.

Electrical wiring 36 extends from an encasement 38 at the rear end of the hair iron. The encasement includes a rotatable control switch 40. The control switch controls heating the ceramic plates and is located at the base of the iron where the cord 36 meets the iron to facilitate the downward motion involved in using the iron. The switch is connected to electrical wiring 42 internally of the upper body 12 (shown at the bottom in FIG. 3), which connects to a circuit board 44, in the upper body 12. Wiring 46 connects from the front of the circuit board to the upper heating plate 18. In similar manner, wiring 48 extends to a corresponding circuit board 50 (shown partially) contained in the lower body 10. Wiring 52 connects from the front of that circuit board to the lower heating plate 16. The circuit boards each contain digital electronics that regulate current delivered to the heating plates 16 and 18. The switch 40 can be a triac based switch that can be rotated to provide a desired temperature range of about 380° to 450° F. and prevent heating the plates over about 450°.

Spacers 54 and 56 formed with central screw openings, respectively 58 and 60 support respective cover plates 62 and 64, each formed with front and rear screw openings, respectively 66, 68 and 70, 72 that cover and shield the circuit boards 44 and 50, which are screwed to the corresponding bodies 10 and 12 by screws such as 74. Front and rear screw pairs 76, 78 and 80, 82 secure the cover plates to the respective bodies 10 and 12 through respective screw openings 66, 68 and 70, 72. Medial plates 73 and 75 help secure the respective cover plates 62 and 64 and provide an assembly for the LED.

Figure 4:
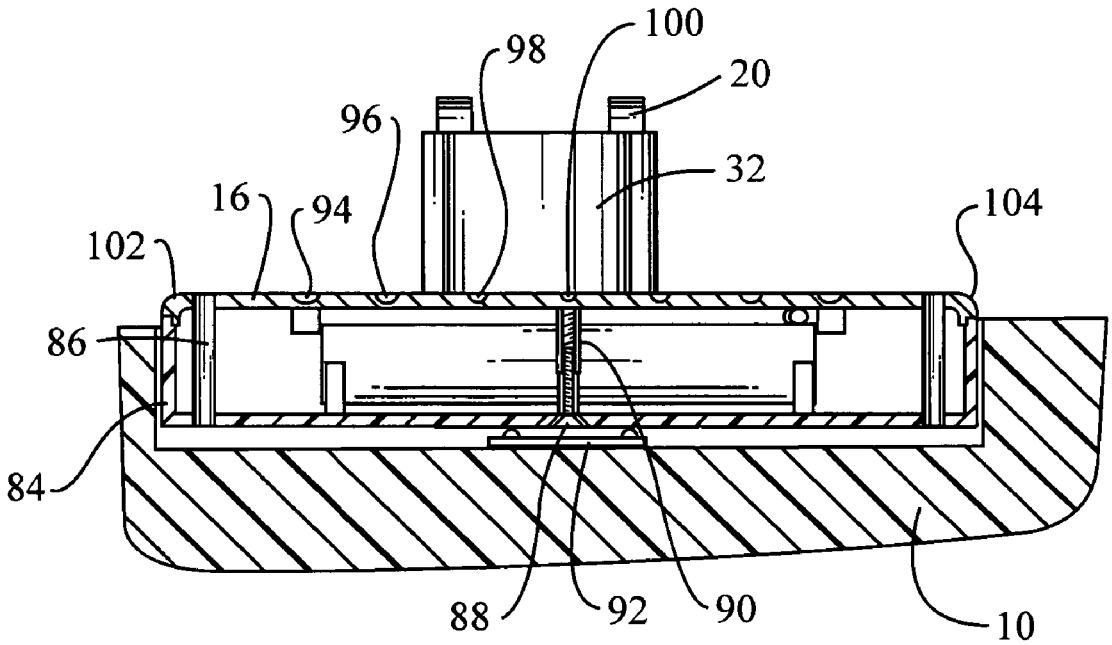
FIG. 4 is cross-sectional of the lower body of the hair iron, taken on the line 4-4 of FIG. 1.

Referring additionally to FIG. 4, the manner of construction and securement of the lower heating plate 16 will be described, but it will be understood that the same description applies to the upper heating plate 18. The heating plate 16 is seated on a bracket 84 that is U-shaped in cross-section and which includes cylindrical uprights, such as at 86, and is secured to the heating plate 16 by a screw 88 and cylindrical receptor 90. The bracket 84 I spaced from the body 10 by a spacer 92.

As shown in each of FIGS. 1 to 4, but most clearly in FIGS. 1 and 2, the outer surface of each of the heating plates 16 and 18 is formed with a plurality of dimples, such as at 94, 96, 98 and 100, distributed over its surface. The dimples 94, 96, 98 and 100 are arranged in an array parallel with opposite outer edges 102 and 104 of the plates 16 and 18 and decrease in size from edges 102 and 104 toward a centerline defined by the dimples 100. In a specific embodiment the radial sizes of the dimples decrease from 3.5 mm to 2 mm to 1.5 mm to 1 mm at the centerline.

In accordance with the invention, a specially prepared acidic coated ceramic plate is used so that conditions are created enhancing the ability of the cuticle to seal, thus protecting the hair and improving color fixation. The acidic plate also is advantageous because there will be no residual acid left on the hair due to the acid functional groups being chemically bound to the coating compound. The plate is formed of aluminum with a ceramic paint coating that contains both powdered tourmaline and zeolite.

Zeolites are acidic minerals that have a micro-porous structure. More than 1500 zeolite types have been synthesized and 48 naturally occurring zeolites are known. Some of the more common mineral zeolites are: analcime, chabazite, heulandite, natrolite, phillipsite, and stilbite. An example mineral formula is: $Na_2Al_2Si_3O_{10}$-$2H_2O$, the formula for natrolite. The Zeolite preferred for the plates is called ZSM-5 in the hydrogen state. Several companies make this material. They include, Zeolyst, Degussa, Zeochem, Grace Davidson. Particularly preferred is the Z30 variant from Zeolyst (the number referring to the silicon to aluminum ratio). The variants affect the thermal stability and acidity of the materials. Acidity and thermal stability are inversely related.

It is preferred to coat the ceramic plates 30 and 41 with tourmaline, which is a precious gemstone, often referred to as the "electric stone" in Asia, due to the negative ions and far infrared heat it emits when heated. The negative ions break down water molecules, making it easier and faster to evaporate moisture from the hair unlike traditional hair dryers which simply blow the water off the hair. In addition to negative ions, far infrared heat waves—invisible to the human eye and known for their therapeutic and healing effects—penetrate deep into the hair shaft to gently heat the hair from within, instead of heating the air around it. This closes the cuticle and provides greater protection by locking moisture into the hair shaft. The use of tourmaline, embedded within a ceramic component of a ceramic or coated on an appliance is known.

Heat generated from the lower and upper heating plates 16 and 18 transmits to the hair. The contact area between the heat and the hair expands between the heating plate 16 and 18. The quantity of the heat to transmit can be adjusted by the switch 40.

The function of the dimples 94, 96, 98 and 100 can be appreciated by considering the nature of hair and the effect of drying and heating. Hair is comprised of an inner region, the cortex, made of a sulfur rich protein called keratin. Keratin is arranged in a bundle of fibers and embodied in elongated cells. The hair strand is surrounded by an outer region called the cuticle which helps to integrate and protect the inner cortex. The cuticle is comprised of dead cells forming a tight overlapping layer. It is designed to lay flat, each cell overlapping another like shingles on a roof, to form a tight skin. If this shingle like structure were to lift forming barbs, individual hair strands would become entangled leading to impaired manageability and impaired function, which will leave pigment vulnerable to decay and refract much of the light reflecting onto and off of the pigment through the cuticle.

Keratin is a polymer, a long chain molecule which represents about 90% of the mass of hair. It is a complex structure comprised of roughly 75% amorphous phase and 25% crystalline phase. The crystalline phase which is made up of microfibrils is embedded in the amorphous matrix. Water is part of the keratin structure and plays an important role in the mechanical properties of hair. The water content of hair is in equilibrium with the relative humidity of the ambient environment, i.e. when it is dry the hair looses water and when it is humid, the hair absorbs water. Under ordinary conditions, 5% of the weight of hair is water.

Some water is held loosely within the keratin structure, while other water is held more strongly. The first kind of interaction is called free water because it can be removed at relatively low temperatures and is akin to evaporation. The second kind of water interaction is called bound water and is more intimately associated with the keratin structure requiring higher temperatures to dislodge it.

Heating hair causes definite changes to its physical and chemical structure which ultimately affects its function. Heating hair up to ~212° F. causes free water to evaporate from the hair. Heating to ~310° F. causes the more strongly bound water to be removed which has the effect of making the hair a bit stiff due to chemical rearrangements within the keratin. Adding water back to the hair either directly or by exposure to ambient water vapor, reverses this process. As one heats the hair still further up to ~450° F., the crystalline region of the keratin begins to melt (sometimes referred to as denaturation), making the hair more compliant and allowing it to be straightened. Upon cooling, recrystallization occurs, fixing the hair in the newly straightened position, or in the case of this invention, allowing pigment to be deeply sealed safely within the crystalline structure. If the hair is dried at temperatures above ~230° F. prior to melting, the recrystallized regions of the hair become less hydrated which can affect its mechanical properties and appearance. In addition to the physical changes to the hair structure associated with heat, when going above ~450° F., hair begins to degrade due to oxidation and at high enough temperatures, the hair will actually burn. Both degradation and burning are irreversible processes and must be guarded against.

The dimples 94, 96, 98 and 100 enable the plates 16 and 18 trap moisture, regulating the rate of moisture release during the drying process. This helps the hair to stay at safe temperature levels while valuable moisture, which aids in the permeation of conditioning chemicals, tends to be retained. The dimples 94, 96, 98 and 100 also will raise the boiling point of water to a slightly higher temperature since the total pressure will increase in a closed system. This situation gives rise to water temperatures of greater than 100° C. without a phase change, which is the underlying principle of a pressure cooker. These higher temperatures will occur, without the generation of steam (without phase change) thus decreasing the tendency for bubbling to occur in the hair strand. The elevated temperature also serves to increase diffusion controlled processes which are involved in the initial reactions with the existing pigment as well as the conditioners present. Additionally, the higher energy of the pressurized water vapor causes the melt temperature of the crystalline region of keratin to be lowered, as well as leading to better fixation of chemical dyes. Lowering the melt temperature decreases the probability of burning the hair, as well as the water vapor contributing to regulating the actual temperature within the hair follicle. Finally the elevated boiling point will allow for faster, more uniform evaporation of surface moisture once the iron is finished with its catalytic effect because the water now exposed to the ambient pressure will be within the temperature range requiring a phase change.

Permanent dyes are formed as a result of chemical reactions. Temperature serves to hasten these chemical reactions. The diffusion of dye intermediates will occur faster at higher pressures and temperatures as well, and being water soluble, the presence of moisture in the hair strand will facilitate dye intermediate diffusion into the hair strand. Raising the temperature of the hair strand makes it more pliable, relaxes it, due to the weakening of hydrogen bonds within the keratin bundle which is a significant mechanism of dye uptake into the hair strand. It also offers more energy into the reaction which speeds up the process; for every 10 C, a doubling of process rate occurs.

The elevated temperature will also increase the retention of temporary dyes. These dyes reside within the cuticle and are more easily dislodged by shampooing than are semi-permanent and permanent dyes. Heat and moisture will tend to swell the cuticle, allowing better permeation of dye molecules. Weak bases, such as ammonia or amines, will enhance the lifting of the cuticle. A highly alkaline condition (pH>8) is necessary for coloring hair and unless rinsed free of the hair, tends to open the cuticle layer. An opened cuticle leads to entanglement of hair strands and loss of color. In the process of drying hair the cuticle tends to contract, trapping dye molecules under its protective layer. Mild acids can be used to help initiate this contraction as well as neutralize the basic reactions of oxidation resulting in the cuticle layer sealing itself more thoroughly. In accordance with the invention, a specially prepared acidic coated ceramic plate is used so that conditions are created causing the cuticle to seal even further, thus protecting the hair and improving color fixation. The acidic plate also is advantageous because there will be no residual acid left on the hair due to the acid functional groups being chemically bound to the coating compound. The plate is formed of aluminum with a ceramic paint coating that contains both powdered tourmaline and zeolite.

Although not usual, it is known to heat hair up to 450° F., or higher. See in this regard respectively U.S. Patent Publication No. 2007/0029302 to Russo, entitled "Ceramic and Tourmaline Hair Appliances", and U.S. Patent Publication No. 2005/0229336 to Fondin et al., entitled "Method of Treating Hair Fibers," the disclosures of which are incorporated herein by reference. However, the combination of a tourmaline coating and the high heat in the range of 380° to 450° F., preferably about 450° F., provides a unique combination not heretofore known or contemplated, particularly, and unexpected since the use of tourmaline itself provides a source of infrared heat.

The present invention is the next leap forward in coloring. It preserves the integrity of color over time. It uses pressure, heat, and acidity along with tourmaline to allow color to deeply penetrate the keratin cortex in a more uniform distribution as well as render the alkaline material inert and contribute to the healthy sealing of the cuticle. In doing so it allows light to reflect with more luminosity off of the pigment granules, and in turn allows for the subjective experience of richer more vibrant color. In the deeper deposit of pigment within the cortex and the sealing of the cuticle the pigment is protected from the elements that could contribute to decay and diffusion, thus, preserving the original canvas the colorist conceived and the end user has come to expect only after leaving the salon.

Although the present invention has been described in connection with the preferred embodiments, it is to be understood that modifications and variations may be utilized without departing from the principles and scope of the invention, as those skilled in the art will readily understand.

The invention claimed is:

1. In a hair iron containing opposed plates having confronting surfaces for clamping a section of hair therebetween, the improvement wherein the surface of at least one of the plates is formed with a plurality of depressions distributed over its surface in which the depressions are of sizes that decrease in diameter from opposite outer edges of the plate toward a centerline substantially centered between the opposite outer edges of the plate.

2. In a hair iron containing opposed plates having confronting surfaces for clamping a section of hair therebetween, the improvement wherein the confronting surface of each of the plates is completely flat except for a plurality of depressions formed on, and distributed over, both of the two dimensions of the surface of each of the plates.

3. A curling iron for styling hair, comprising:

flat opposed plates formed of zeolite and coated with tourmaline and carried on the outer ends of two arms that are hinged together at their opposite ends to form a base end;

electric wiring cord for the hair iron extending from the base end;

the plates having confronting surfaces for clamping a section of hair therebetween;

the confronting surfaces of the opposed plates being formed with a plurality of dimples distributed over its surface, decreasing in diameter from opposite outer edges of the plates toward the centerlines of the plates;

means for providing heat to at least one of the plates controlled by a switch located at the base end of the iron where the cord extends therefrom, whereby heat in the range of about 380-450° F. can be applied to said section of hair while clamped between the plates; and means for regulating current to the at least one plate.

* * * * *